United States Patent [19]

Wincek

[11] 4,015,587

[45] Apr. 5, 1977

[54] FIREPLACE DAMPER OPERATING MECHANISM

[76] Inventor: Walter R. Wincek, 3251 Alpine St., NE., Canton, Ohio 44721

[22] Filed: Mar. 11, 1976

[21] Appl. No.: 666,144

[52] U.S. Cl. ..... 126/286; 126/288

[51] Int. Cl.[2] ..... F23L 11/00

[58] Field of Search ..... 126/286, 288, 295; 403/312, 306

[56] References Cited

UNITED STATES PATENTS

| | | | |
|---|---|---|---|
| 157,427 | 12/1874 | Stuart | 403/312 |
| 421,141 | 2/1890 | Rankin | 126/288 |
| 907,523 | 12/1908 | Perry | 403/312 |
| 2,996,064 | 8/1961 | Haas | 126/288 |
| 3,831,582 | 8/1974 | Mahoney | 126/286 |

*Primary Examiner*—John J. Camby
*Assistant Examiner*—Larry I. Schwartz
*Attorney, Agent, or Firm*—Frease & Bishop

[57] ABSTRACT

A mechanism for mounting within a firebox of an existing fireplace to control the opening and closing of a pivotally mounted flue damper plate. A vertically extending connecting rod is connected at its upper end to the damper plate. An L-shaped control rod is eccentrically connected to the lower end of the connecting rod adjacent the rear of the firebox for vertically moving the connecting rod upon rotation of the control rod. The control rod is rotatably mounted on and extends beneath a usual fuel holding grate supported on the floor of the firebox. The front end of the control rod extends upwardly in front of and above the grate when the damper is in closed position obstructing placement of fuel on the grate and lighting of a fire therein and providing a visual indication that the damper plate is closed. Rotation of the front end of the control rod from a vertical position to a horizontal position rotates the control rod which in turn moves the connecting rod vertically upwardly to pivotally swing the damper plate from closed to open position. A latch is mounted on the grate to secure the front end of the control rod when in a horizontal position to maintain the damper in open position.

9 Claims, 7 Drawing Figures

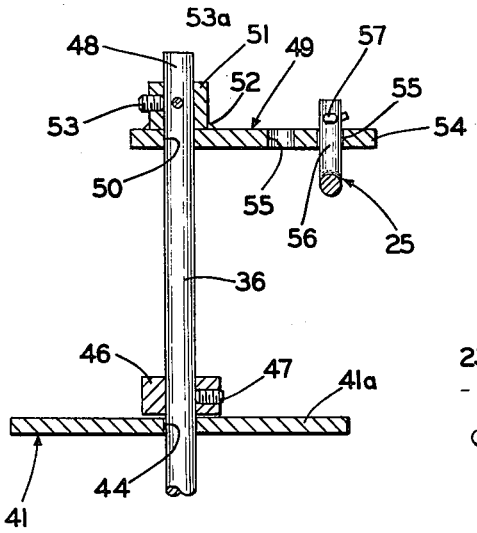
FIG. 4
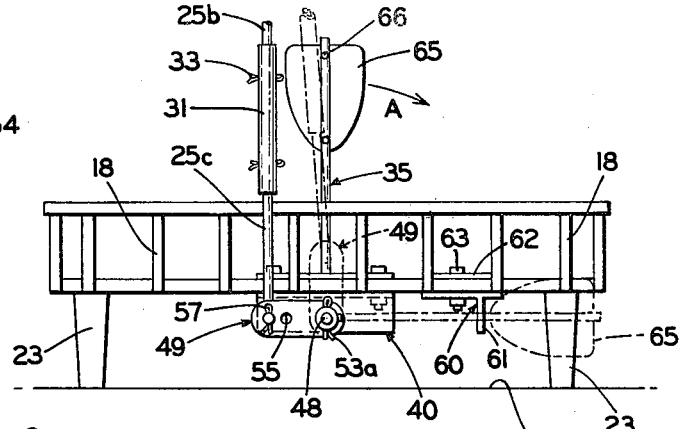
FIG. 3
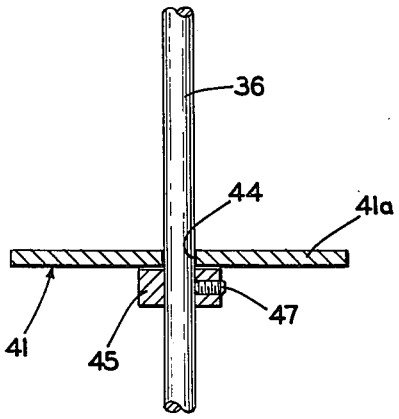
FIG. 5
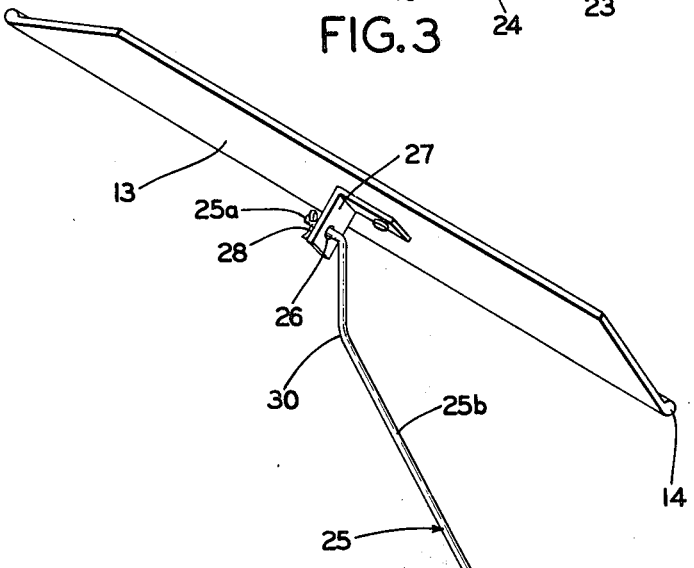
FIG. 6
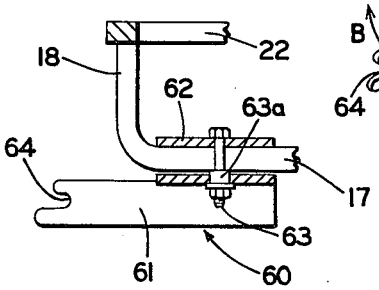
FIG. 7
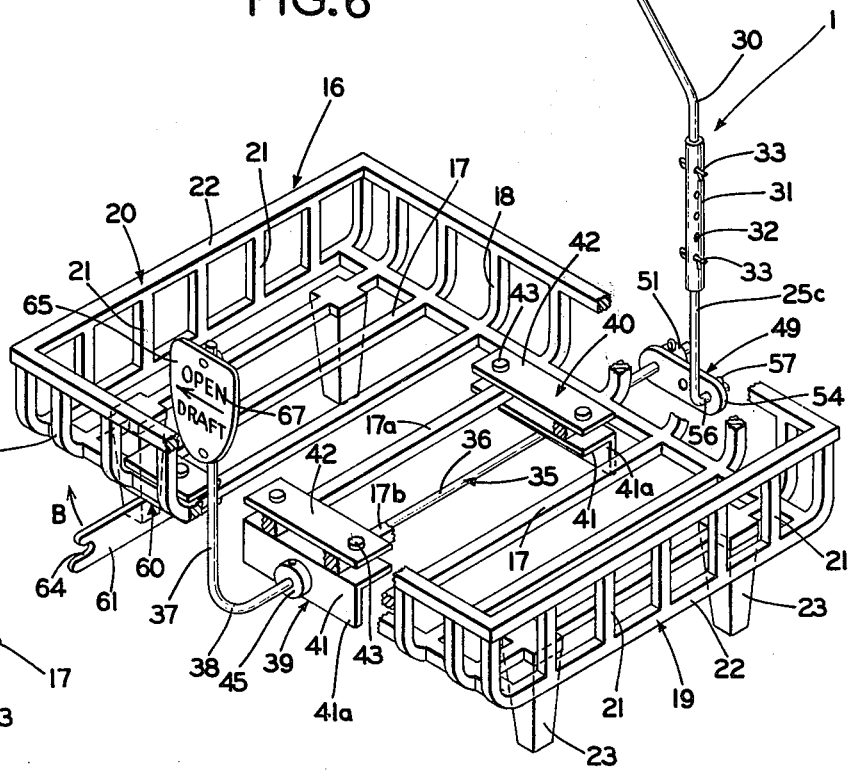

FIREPLACE DAMPER OPERATING MECHANISM

BACKGROUND OF THE INVENTION

1. Field of the Invention

The invention relates to fireplaces, and in particular, to operating mechanisms for control of a chimney flue damper at the top of the fireplace. More particularly, the invention relates to a damper operating mechanism which can be mounted within an existing fireplace easily and economically for controlling the damper position and to prevent accidental starting of a fire in the fireplace when the damper is closed.

2. Description of the Prior Art

Various types of fireplace damper mechanisms for opening and closing the damper plate have been developed and are in use today. One of the most common types is a poker control type, wherein the damper plate is operated by working the poker in a ring hanging down from the plate, which is either pulled or pushed to move the plate. Another type is the chain control type, wherein the damper plate is pivotally mounted along its center and is opened and closed by selectively pulling one of two chains. Another type of damper control is the rotary control type, wherein the damper plate is operated by turning a knob or handle usually located on the front of the fireplace, which in turn rotates a shaft to raise and lower the damper plate by various gear or link mechanisms.

It is preferable that the damper plate control mechanism be located exteriorly of the firebox, eliminating the operator reaching into the firebox for controlling the damper which, unless done by an instrument such as a poker, may result in his hands or clothes becoming soiled. Such internal mechanisms are difficult to operate when the firebox is hot or warm after a fire, and especially when a damper operation is required while a fire is in the firebox. Likewise, most of these internal operating mechanisms do not provide a readily visual indication to an operator of the position of the damper plate. This lack of position indication possibly may result in a fire being started with the damper closed.

Due to the difficulty of operating many damper mechanisms and the possibility that a fire may be started in the fireplace when the damper is closed, many people do not close the damper between fires. This results in room heat escaping through the open chimney flue during the winter months, as well as providing an entrance opening for insects and small animals into the house during the summer months.

Examples of several known damper constructions and the control mechanisms therefor may be found in U.S. Pat. Nos. 165,440, 421,141, 548,889, 732,380, 817,183, 926,048, 951,430, 1,669,825, 1,901,753 and 1,987,074.

Many of these damper operating mechanisms and others known in the art are suitable for their intended purpose. However, many of these mechanisms require expensive and complicated components which are difficult to obtain, install and maintain. Also, most of these known control mechanisms must be installed during the construction of the fireplace, otherwise, considerable masonry work, and the mounting of brackets, drilling of holes, etc., are required to install the mechanism in an already existing fireplace.

Therefore, the need has existed in the art for a fireplace damper operating mechanism which is of a simple and rugged construction, which can be installed easily and quickly within an existing fireplace, and which provides a means of preventing the accidental starting of a fire with the damper in closed position. No other damper operating mechanism of which I am aware provides such features and advantages, and eliminates these prior art problems.

SUMMARY OF THE INVENTION

Objectives of the invention include providing a fireplace damper operating mechanism which gives a visual indication of the fireplace damper position, and which functions as an obstruction in front of the fireplace for the placement of fuel within a fireplace grate to eliminate the accidental starting of a fire in the fireplace when the damper is in closed position; providing such a mechanism which is formed of simple, rugged, inexpensive and readily obtainable parts and components which, when assembled, have a minimum number of moving parts, and which mechanism includes adjustment means to insure complete closure of the damper and to permit a predetermined size of damper opening; providing such a control mechanism which is intended to be installed primarily in an existing fireplace without requiring expensive and complicated masonry work such as the drilling of holes and mounting of members thereto, as in prior damper control mechanisms, and in which the improved mechanism is adapted to be mounted on most known types of fuel supporting grate structures by a plurality of inexpensive, adjustable brackets; providing such a contral mechanism which includes latch means for engagement with an operating handle to insure that the damper plate is in its proper open position and to prevent accidental closing of the damper plate, and in which an attractive, decorative plate may be mounted on the top of the handle with printed indicia thereon to provide an attractive appearance to the fireplace and to indicate the damper position; and providing a mechanism of simple construction which eliminates installation, maintenance and repair problems, which achieves the stated objectives in a simple, effective and inexpensive manner and which solves problems and satisfies needs existing in the art.

These and other objectives and advantages may be obtained by the fireplace damper operating mechanism, the general nature of which may be stated as including a damper plate pivotally mounted within a chimney flue for swinging movement between open and closed positions; connecting rod means extending generally vertically downwardly from the damper plate and having upper and lower ends, with the upper end being operatively connected to the damper plate; grate means located generally beneath the damper plate within a firebox of the fireplace; generally L-shaped control rod means having horizontal leg and vertical handle portions with the leg portion being rotatably mounted on the grate means and extending horizontally centrally beneath the grate means between the front and rear of the firebox; link means operatively connecting the rear end of the leg portion of the control rod means to the lower end of the connecting rod means; the handle portion of the control rod means being located centrally in front of the grate means and adapted to swing through an approximate 90° arc between damper closed and open indicating positions, the handle portion extending generally vertically upwardly in front of and above the grate means when in closed damper indicating position and extending generally horizontally along the front of the grate means when in damper open indicating position; latch means mounted on the front of the grate means and engageable with the handle portion for securing the control rod means in horizontal position when the damper plate is in open position; and in which movement of the handle portion through the 90° arc rotates the control rod means and moves the connecting rod means vertically to swing the damper plate between open and closed position through the link means connection.

BRIEF DESCRIPTION OF THE DRAWINGS

A preferred embodiment of the invention — illustrative of the best mode in which applicant has contemplated applying the principles — is set forth in the following description and shown in the accompanying drawings, and is particularly and distinctly pointed out and set forth in the appended claims.

FIG. 3 is an enlarged fragmentary rear end elevational view looking in the direction of arrows 3—3, FIG. 2;

FIG. 4 is an enlarged fragmentary sectional view taken on line 4—4, FIG. 2;

FIG. 5 is an enlarged fragmentary sectional view taken on line 5—5, FIG. 2;

FIG. 6 is a perspective view with portions broken away and in section, of the improved damper operating mechanism mounted on a fireplace grate and removed from a fireplace; and FIG. 7 is an enlarged, fragmentary sectional view of the latch mechanism taken on line 7—7, FIG. 1.

Similar numerals refer to similar parts throughout the drawings.

DESCRIPTION OF THE PREFERRED EMBODIMENT

Figure 2:
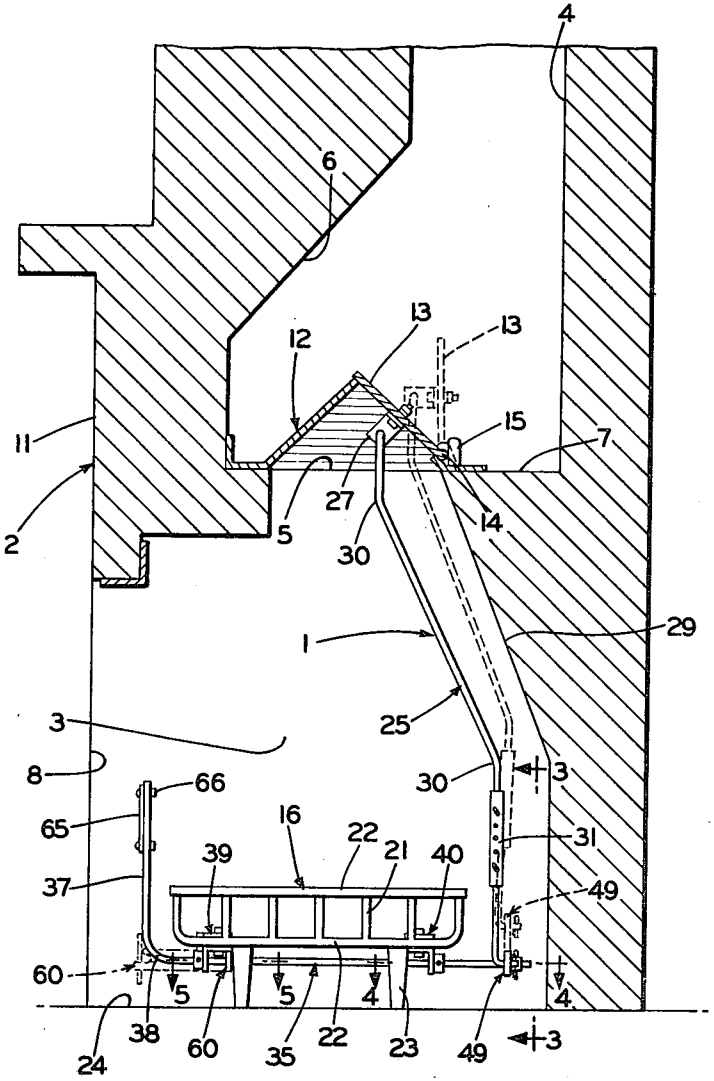
FIG. 2 is a sectional view taken on line 2—2, FIG. 1, with the damper plate being shown in full lines in closed position and in dash lines in open position.
Figure 1:
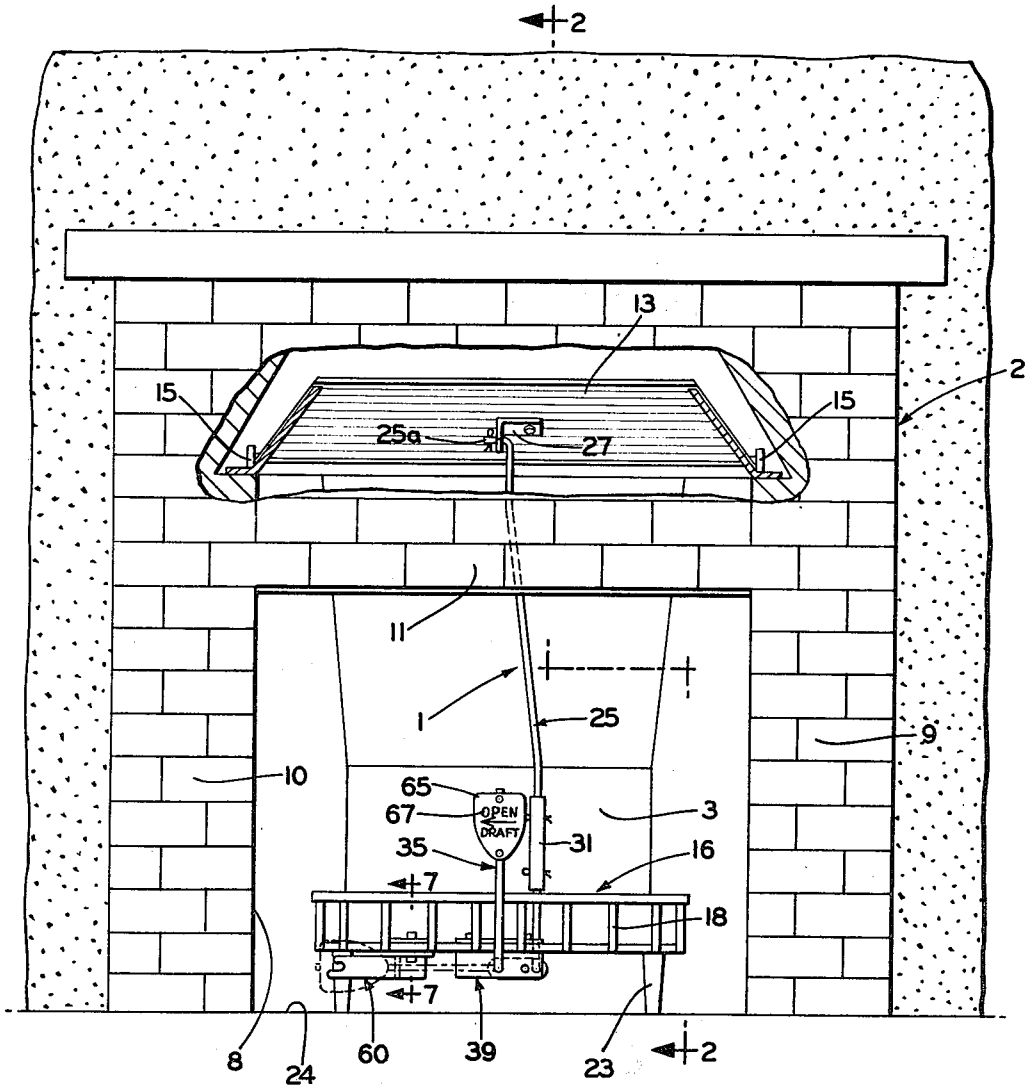
FIG. 1 is a front elevation view with portions broken away, of the fireplace damper operating mechanism assembled within a fireplace.

The improved fireplace damper operating mechanism is indicated generally at 1, and is shown mounted within a usual fireplace 2 in FIGS. 1 and 2. Fireplace 2 is of a usual construction consisting of a lower firebox 3, having a chimney flue 4 communicating with firebox 3 through a flue opening 5. A smoke chamber 6 is formed in the lower portion of chimney flue 4 having a smoke shelf 7 at the bottom. A firebox front opening 8 is defined by fireplace side walls 9 and 10, and upper front face portion 11.

A usual damper assembly, indicated generally at 12, is mounted within smoke chamber 6, preferably supported on smoke shelf 7. Assembly 12 includes a damper plate 13 for opening and closing flue opening 5. Damper plate 13 (FIG. 6) is of a usual rectangular configuration having an edge 14 pivotally mounted within a bracket 15 (FIG. 2) to permit pivotal swinging movement of plate 13 for moving between opened and closed positions.

The improved damper operating mechanism 1 is shown particularly in FIG. 6 mounted on a usual fireplace grate 16, which is adapted to be mounted within firebox 3 for holding logs, coal or other fuel to be burned within the firebox. Grate 16 may be of a usual construction consisting of a fuel supporting shelf formed by a plurality of horizontally extending bars 17. Bars 17 terminate in upwardly turned ends 18 which form the front and rear walls of the grate. Grate side walls 19 and 20 are formed by a plurality of vertically extending bars 21, and top and bottom horizontal connecting bars 22. A plurality of legs 23 support the grate on firebox floor 24 permitting air to flow beneath fuel supporting bars 17. Other types, styles and arrangements of grate 16 may be used in combination with damper mechanism 1 without affecting its operation or inventive concept.

In accordance with the invention, damper operating mechanism 1 includes a connecting rod 25 which is operatively connected to damper plate 13 by means of an offset end 25*a* extending through a hole 26 which is formed in an L-shaped bracket 27 attached to damper plate 13. A cotter pin 28 extends through an opening formed in offset end 25*a* of connecting rod 25. Rod 25 extends generally vertically downwardly along the back wall 29 of firebox 3 (FIG. 2) and in most installations will have upper and lower offset angles 30 formed therein, enabling rod 25 to more closely follow the contour of back wall 29. Connecting rod 25 preferably is formed in two sections 25*b* and 25*c*, which are joined by a hollow sleeve 31. Sleeve 31 is provided with a plurality of holes 32 for adjusting the length of rod 25. The ends of rod sections 25*b* and 25*c* are joined with sleeve 31 by cotter pins 33.

An L-shaped control rod, indicated generally at 35, extends from the front of grate 16 to the rear thereof for vertically moving connecting rod 25 to open and close damper plate 13. Control rod 35 has a first or horizontal leg portion 36 and a second leg or handle portion 37, both of which are integrally joined at a right angle corner 38. Control rod 35 is rotatably mounted on grate 16 by front and rear bracket assemblies 39 and 40 (FIG. 6). Bracket assemblies 39 and 40 each include a small section of angle iron 41 which is mounted on and suspended beneath the grate on a pair of adjacent grate bars 17*a* and 17*b* by upper clamping plates 42 and bolts 43. Horizontal leg portion 36 extends through a pair of horizontally aligned openings 44 formed in the vertical leg 41*a* of angle iron sections 41 (FIGS. 4 and 5). Front and rear collars 45 and 46, respectively, maintain rod 35 in position on grate 16 and control horizontal movement thereof. Collars 45 and 46 are secured to horizontal leg portion 36 by set screws 47.

The extended rear end 48 of rod leg 36 is operatively connected to the bottom end of connecting rod 25 by a link bar 49. One end of link bar 49 is firmly fixed with respect to end 48 of rod 35, as shown in FIG. 4. Rod end 48 extends through an opening 50 in one end of link bar 49 and through an opening in a collar 51 which is secured by welds 52 to link bar 49. A set screw 53 and cotter pin 53*a* clamps the link bar through collar 51 to rod end 48. The swinging end 54 of link bar 49 is formed with a plurality of openings 55 for loosely, pivotally receiving an offset angled end 56 of connecting rod 35 therethrough (FIGS. 4 and 6). Rod end 56 is secured within a selected opening 55 by a cotter pin 57.

A latching mechanism 60 (FIGS. 6 and 7) is mounted on grate 16 adjacent the front, and offcenter thereof, for engaging handle portion 37 of control rod 35 when the damper plate is in open position, as shown in dot-dash lines, FIGS. 1 and 3. Latch mechanism 60 includes a T-shaped latch plate 61 pivotally mounted beneath the grate bars by an upper clamping plate 62 and a bolt 63. A spacer 63*a* pivotally mounts latch plate 61 on bolt 63 for swinging movement from the rod engaging position of FIG. 6 in the direction of arrow B to beneath the grate and to the unlatched position. The front of latch plate 61 projects forwardly of vertical bar ends 18 when in rod engaging position, and is formed with a U-shaped rod receiving notch 64 therein.

A damper position indicating plate 65 is mounted on the extended end of handle portion 37 of control rod 35 by bolts 66. Position indicating indicia 67 preferably is printed on or formed on the front of plate 65, visually indicating the position of damper plate 13 or providing instruction for operation thereof.

Damper operating mechanism 1 is shown in a damper closed position in FIG. 6 and in solid lines in FIGS. 1 and 2. Manual movement or rotation of control rod handle 37 in a downward direction, indicated by arrow A, FIG. 3, through an approximate arc of 90°, rotates horizontal leg portion 36 in a counterclockwise direction in viewing FIG. 3. Such rotation of rod 35 in turn, rotates link bar 49 in a counterclockwise direction due to the rigid connection between link 49 and horizontal rod portion 36. The counterclockwise movement of link end 54 moves connecting rod 25 in a generally upwardly vertical direction, pivoting damper plate 13 from its full line closed position to its open dot-dash line position of FIG. 2 through the pivotal connection of damper plate edge 14 with bracket 15. Latch plate 61 swings horizontally from beneath grate 16, enabling handle portion 37 to be latched in notch 64 of latch plate 61 preventing premature and accidental closure of damper plate 13.

To close damper plate 13, the reverse operation described above occurs. Latch plate 61 is pivoted manually horizontally rearwardly to release handle 37 from within latch notch 64. Swinging movement of handle 37 from its damper open horizontal position to the damper closed vertical position of FIG. 6 pivotally lowers damper plate 13 by the downward force exerted on angle end 56 of connecting rod 25 by the clockwise rotation of link bar 49.

One of the main features of improved operating mechanism 1 is the simple, rugged construction thereof, requiring only a pair of rods 25 and 35 which preferably are inexpensive solid cylindrical metal bars, together with readily available, inexpensive bracket assemblies 27, 39, 40 and 60, link plate 49, and associated cotter pins, bolts, etc. In accordance with the invention, operating mechanism 1 is intended primarily for installation in an existing fireplace. Mechanism 1 requires only a usual grate construction for mounting control rod 35 thereon, eliminating the need for any masonry work or the attachment of brackets, rods, etc., on the fireplace, as in prior known constructions. The only drilling required may be a hole, if one is not available, for mounting bracket 27 on the existing fireplace damper plate 13.

Most grate constructions have a bottom wall or fuel shelf formed of open rods or similar latice-like structure, as shown in FIG. 6, enabling control rod 35 to be mounted beneath the grate by brackets 39 and 40, or a simple modification thereof to match a particular grate bar arrangement. Bracket assemblies 39, 40 and 60 are readily adjustable on grate 16 by longitudinal movement along grate bars 17. Likewise, additional holes can be provided in clamping plates 42 and the horizontal sections of angle irons 41, if desired, to accommodate various spacings between grate bars.

Another of the main features of the invention is the projection of operating handle 37 upwardy in front of and preferably above grate 16 (FIGS. 1 and 2) obstructing the placement of logs, coal or other fuel, or the igniting of fuel already contained in grate 16, by an individual without being aware that the flue is closed. Indicating plate 65 may be made in various colors and with ornamental designs to provide a decorative appearance to the mechanism and to provide greater visual effect to operating handle 35.

Operating mechanism 1 consists of a minimum number of moving parts, none of which require expensive machining, milling or casting to produce. Sleeve 31 permits adjustment of the length of connecting rod 25, depending upon the height of damper plate 13 above firebox floor 24, and the particular height of the bottom rods of grate 16. Also, the providing of a plurality of holes 55 in link plate 49, together with sleeve 31 provides additional adjustment to insure the complete closing and a desired amount of opening of damper plate 13.

Accordingly, the improved fireplace damper control mechanism is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the fireplace damper operating mechanism is constructed and used, the characteristics of the construction, and the advantageous, new and useful results obtained; the new and useful structures, devices, elements, arrangements, parts, and combinations, are set forth in the appended claims.

I claim:

1. Fireplace damper operating mechanism for a fireplace of the type having a firebox and chimney flue including:

a. a damper plate pivotally mounted within the chimney flue for swinging movement between open and closed positions;

b. connecting rod means extending generally vertically downwardly from the damper plate, said connecting rod means having upper and lower ends with said upper end being operatively connected to the damper plate;

c. grate means located generally beneath the damper plate within the firebox;

d. latch means mounted on the front portion of the grate means;

e. generally L-shaped control rod means having first and second leg portions with said first leg portion being rotatably mounted on the grate means and extending generally horizontally centrally beneath the grate means between the front and rear of the firebox;

f. link means operatively connecting the rear end of said first leg portion to the lower end of the connecting rod means;

g. the second leg portion of the control rod means being located centrally in front of the grate means and adapted to swing through an approximate 90° arc between damper closed and open indicating positions, said second leg portion extending generally vertically upwardly in front of and above the grate means when in closed damper indicating position and extending generally horizontally along the front of the grate means and engageable with the latch means when in damper open indicating position to latch the control rod means in damper open position; and h. movement of the second leg portion through the 90° arc rotates the control rod means to move the connecting rod means vertically to swing the damper plate between open and closed positions through the link means connection.

2. The mechanism defined in claim 1 in which plate means is mounted on the upper end of the second leg portion of the L-shaped control rod means; and in which printed indicia pertaining to the damper position is displayed on said plate means.

3. The mechanism defined in claim 1 in which the link means includes a link bar having first and second ends; in which said first end is rigidly mounted on the rear end of the first leg portion for rotating the link bar upon rotation of the control rod means; and in which the second end of the link bar is engaged with the lower end of the connecting rod means for vertically moving said connecting rod means upon rotation of the control rod means.

4. The mechanism defined in claim 1 in which the connecting rod means is formed in sections; and in which sleeve means telescopically join the sections to permit adjustment of the length of the connecting rod means.

5. The mechanism defined in claim 1 in which a pair of spaced bracket means are mounted on the grate means having plate portions extending vertically downwardly from the grate means; in which horizontally aligned openings are formed in the vertically extending plate portions; and in which the first leg portion of the control rod means extends through said plate openings to rotatably mount said control rod means on the grate means.

6. A damper operating mechanism for mounting in an existing fireplace of the type having a firebox, a fuel supporting grate located within the firebox, and a damper plate pivotally mounted for opening and closing a flue opening formed at the top of the firebox; said operating mechanism including:

a. bracket means adapted to be mounted on the swinging end of the damper plate;

b. connecting rod means attached to said bracket means on the swinging end of the damper plate to swing said damper plate between open and closed positions, said connecting rod means extending generally vertically downwardly from the damper plate;

c. L-shaped control rod means having horizontal leg and vertical handle portions;

d. second bracket means adapted to be mounted on the grate for rotatably mounting the horizontal leg portion of the control rod means centrally beneath the grate and extending horizontally between the front and rear of the grate;

e. link means having first and second ends extending between and operatively connecting the control rod means with the connecting rod means;

f. the link means first end being rigidly fixed to an end of the horizontal leg portion of the control rod means at the rear of the grate for imparting swinging movement to the second end of the link means upon rotation of the control rod means;

g. the handle portion of the control rod means being adapted to be located centrally in front of the grate when the control rod means is mounted on the grate and to swing between generally horizontal and vertical positions for opening and closing the damper plate, said handle portion being adapted to extend generally vertically upwardly in front of and above the grate when the damper is in closed position obstructing placement of fuel on the grate, and extend generally horizontally along the front of the grate when the damper plate is in open position; and h. latch means adapted to be mounted on the front of the grate and engageable with the handle portion for securing the control rod means in horizontal position when the damper plate is in open position.

7. The mechanism defined in claim 6 in which the control rod means is a solid metal cylindrically-shaped bar with the horizontal leg and handle portions being integrally joined at right angles.

8. The mechanism defined in claim 6 in which the latch means includes a latch plate adapted to project outwardly from the front of the grate; in which notch means is formed in the latch plate; and in which the handle portion of the control rod means is engaged within the notch means when said handle portion is in a horizontal position.

9. The mechanism defined in claim 6 in which the second bracket means includes front and rear bracket assemblies; in which each of said bracket assemblies has a bottom right-angle plate with integrally joined horizontal and vertical sections, and an upper clamping plate; in which fastening means are adapted to mount the clamping plates and angle plates on a grate; and in which the vertical sections of the angle plates are formed with horizontally aligned holes, with the horizontal leg portion of the control rod extending through said holes to rotatably mount the control rod means on a grate.

* * * * *